US007443311B2

(12) United States Patent
Primak et al.

(10) Patent No.: US 7,443,311 B2
(45) Date of Patent: Oct. 28, 2008

(54) CHAIR MOUNTED SYSTEM FOR CONTROL BASED ON USE OF CHAIR

(76) Inventors: Boris Primak, 35 Seacoast Ter., #21J, Brooklyn, NY (US) 11235; Leonid Primak, 301 Elizabeth St., #7L, New York, NY (US) 10012

( * ) Notice: Subject to any disclaimer, the term of this patent is extended or adjusted under 35 U.S.C. 154(b) by 206 days.

(21) Appl. No.: 11/410,872

(22) Filed: Apr. 26, 2006

(65) Prior Publication Data

US 2006/0290527 A1 Dec. 28, 2006

Related U.S. Application Data

(60) Provisional application No. 60/693,100, filed on Jun. 23, 2005.

(51) Int. Cl.
*G08B 21/00* (2006.01)

(52) U.S. Cl. ..... 340/686.1; 340/686.3; 340/686.4

(58) Field of Classification Search ..... 340/539.1, 340/539.19, 572.8, 665, 666, 667, 668.1, 340/686.3, 686.4; 235/380, 382.5; 345/156, 345/157; 297/316

See application file for complete search history.

(56) References Cited

U.S. PATENT DOCUMENTS

| | | | | |
|---|---|---|---|---|
| 5,612,718 | A * | 3/1997 | Bryan | 345/168 |
| 5,909,208 | A * | 6/1999 | Blomdahl | 345/156 |
| 6,870,477 | B2 * | 3/2005 | Gruteser et al. | 340/573.1 |
| 6,964,370 | B1 * | 11/2005 | Hagale et al. | 235/380 |
| 6,970,080 | B1 * | 11/2005 | Crouch et al. | 340/539.26 |
| 7,327,268 | B2 * | 2/2008 | Gruteser et al. | 340/573.1 |

* cited by examiner

*Primary Examiner*—Van T. Trieu
(74) *Attorney, Agent, or Firm*—David H. Siegel

(57) ABSTRACT

A chair based interface comprising a lower portion attachable to the base of a two part chair and an upper portion attachable to the shaft of a two part chair. A rocker arm connects the two portions and depresses an internal switch when pressure is placed on the chair. A wireless transmitter and receiver and attached interface can control a computer or other device based on the activation or deactivation of the switch. The device can be integrated into or attached to a chair during manufacturing or attached after market.

14 Claims, 7 Drawing Sheets

CHAIR MOUNTED SYSTEM FOR CONTROL BASED ON USE OF CHAIR

CROSS-REFERENCE TO RELATED APPLICATIONS

This application claims the benefit of U.S. Provisional Application No. 60/693,100, filed Jun. 23, 2005.

BACKGROUND OF THE INVENTION

1. Field of the Invention

The present invention generally relates to a mechanism attachable to or incorporable in a chair, and more particularly a mechanism for detecting a change in the state of a chair and transmitting it to a receiver.

2. Description of the Related Art

Chairs are the generally preferred seating arrangement in office settings. A number of devices exist to monitor the chair's occupant in various ways, and are designed for either incorporation into the chair (U.S. Pat. No. 6,870,477), positioning near the chair (U.S. Pat. No. 6,204,767), or interaction with devices attached to the user (U.S. Pat. No. 6,964,370). What does not exist is a low-cost mechanism for control of a computer or other system or device that can be integrated by a manufacturer into an existing chair design without a significant redesign or attached after purchase by a consumer.

The invention fills this gap in the art. An inexpensive and simple to produce device capable of being permanently or semi-permanently attached to a chair, either during production or after-market, is described.

BRIEF SUMMARY OF THE INVENTION

The present invention is an interface comprising a receiver, a transmitter, and a sensing mechanism coupled to the transmitter. The sensing mechanism comprises a switch compartment having a switch, a fulcrum, and a rocker arm mounted on the fulcrum and in mobile contact with the switch, and a track mounting having a groove or rail with which the end of the rocker arm opposite the end in contact with the switch is in contact with.

In the preferred embodiment, the receiver is in communication with a computer and capable of controlling said computer, the track mounting is attached to the base of a two-part chair, the sensing mechanism and the transmitter are enclosed in a box attached to the shaft of a two-part chair, and the rocker arm has a roller attached to the end in mobile contact with the rail.

In other embodiments, the sensing mechanism and transmitter can be embedded into the upper part of a two part chair, and the track mounting embedded into base at the time of manufacture.

By disabling or locking a computer when the switch is released, indicating the user has risen from the chair, or a pre-set period of time thereafter, electrical use can be made more efficient and computer use more secure.

In this application, a two part office chair refers to a type of chair in which a support portion is connected to a seat by a central shaft containing a compressible support such as a hydraulic or pneumatic column or a spring.

Bluetooth refers to the Bluetooth wireless communication standard.

RFID refers to Radio Frequency Identification.

WiFi refers to the 802.11 wireless networking standard defined by the Institute of Electrical and Electronics Engineers and any of its sub-standards.

BRIEF DESCRIPTION OF THE SEVERAL VIEWS OF THE INVENTION

DETAILED DESCRIPTION OF THE INVENTION

Figure 1:
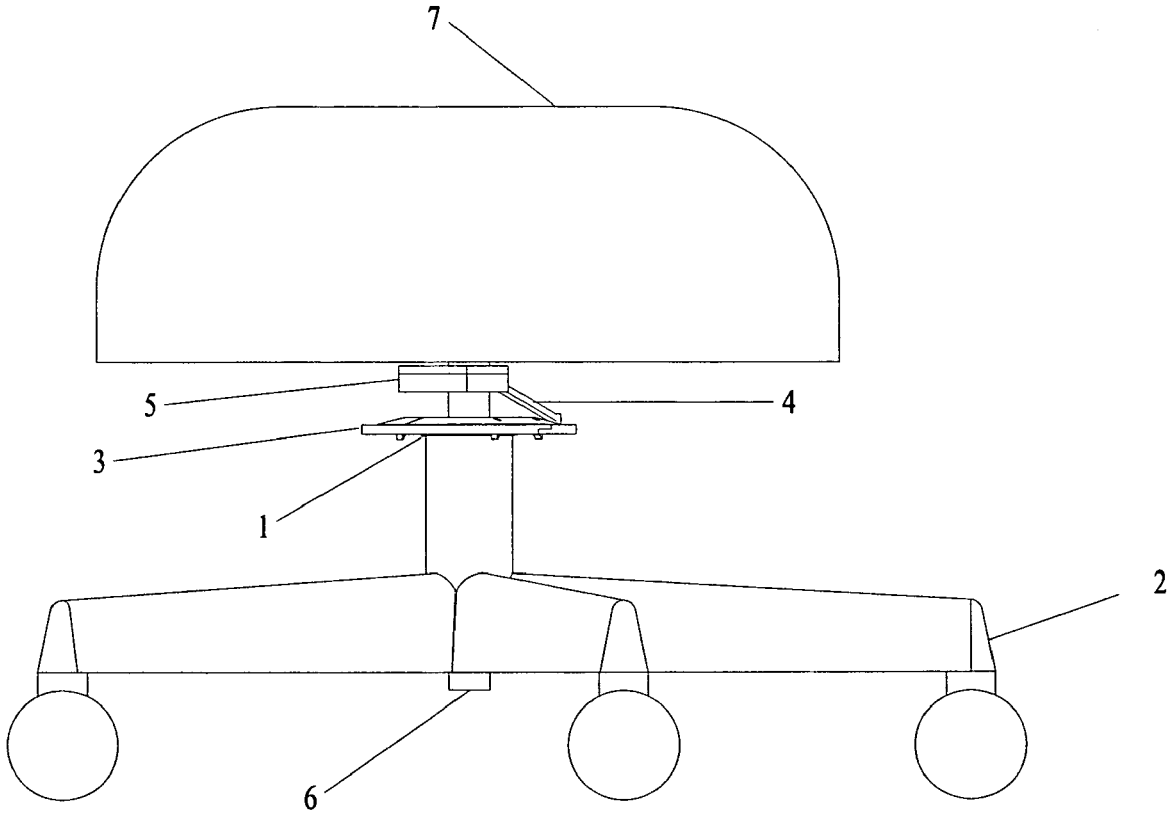
FIG. 1 is a side view of the preferred embodiment of the device mounted on a chair.
Figure 2:
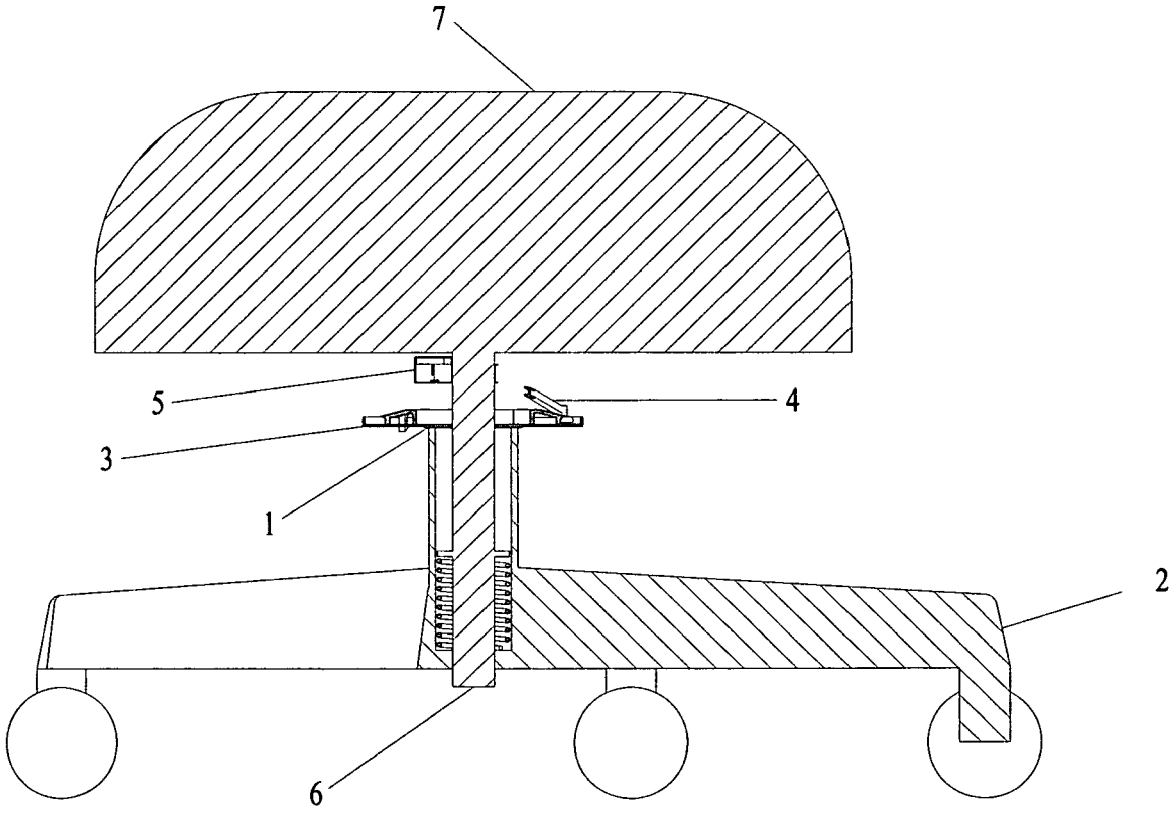
FIG. 2 is a sectional view of the device of FIG. 1.

As shown in FIG. 1, the device comprises a track mounting 1, which can be attached to a chair base 2, a rail 3 running along the circumfrence of the top of the track mounting 1, a rocker arm 4 in mobile contact with the rail 3 and attached at the opposite end to the switch compartment 5, mountable on the shaft 6 of the chair seat 7.

Figure 3:
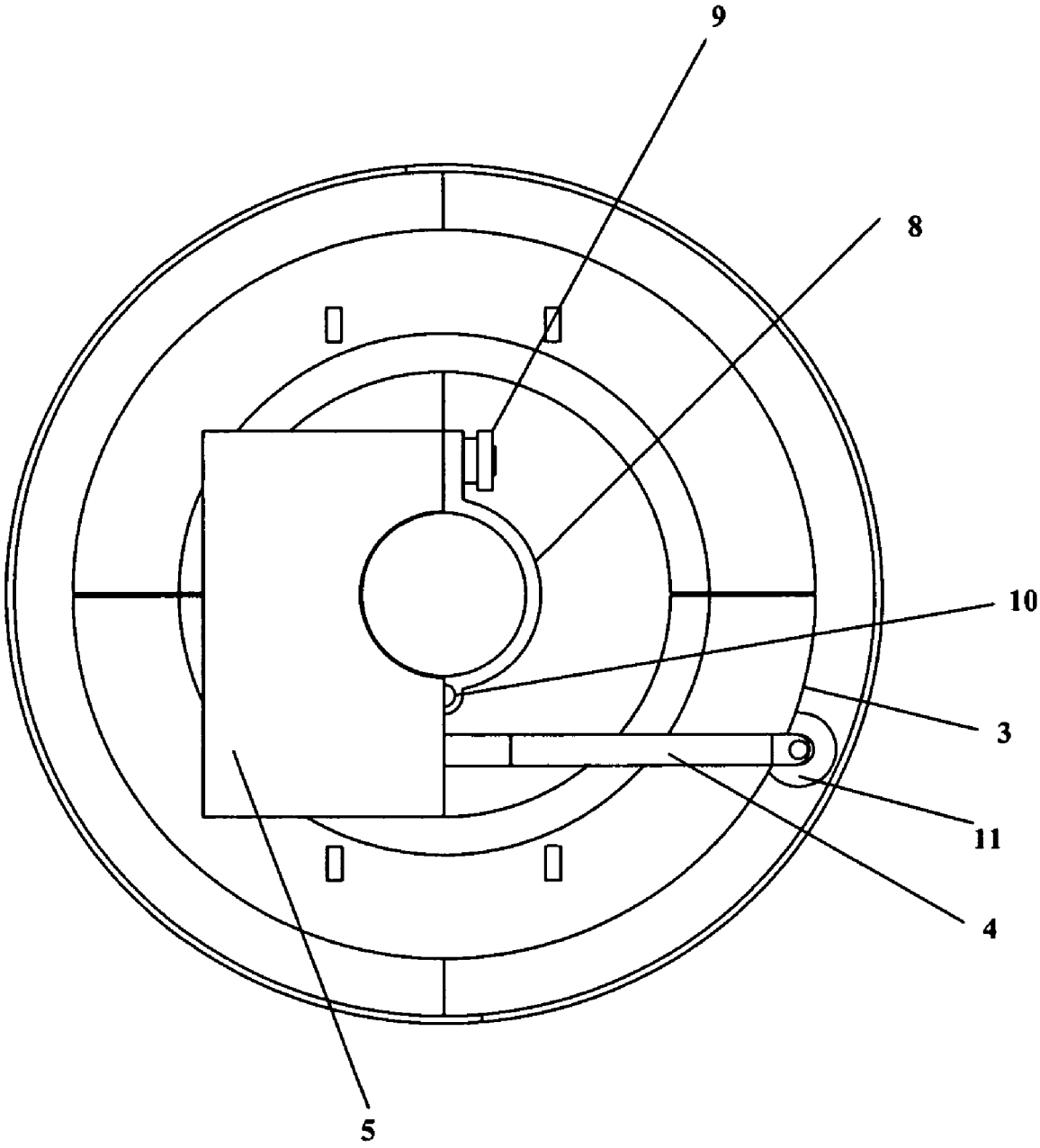
FIG. 3 is a top view of the preferred embodiment of the device with chair removed.
Figure 4:
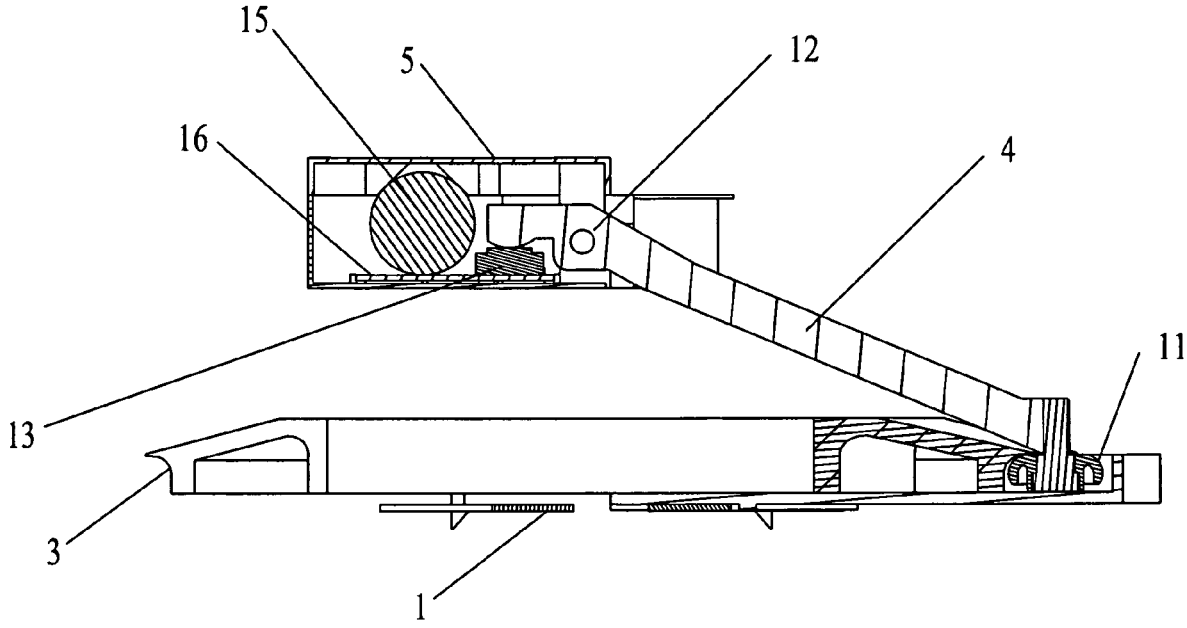
FIG. 4 is a sectional side view of the device of FIG. 3.
Figure 5:
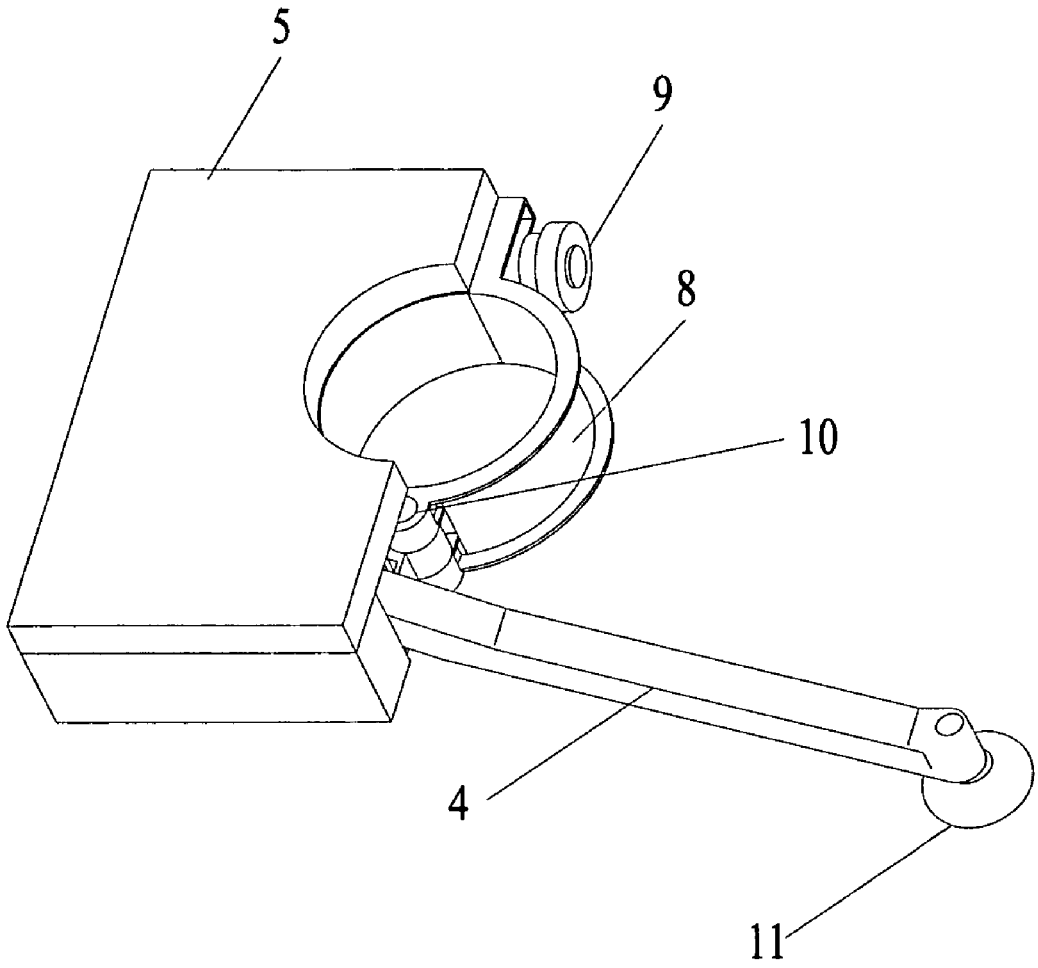
FIG. 5 is a top view of the switch compartment.
Figure 6:
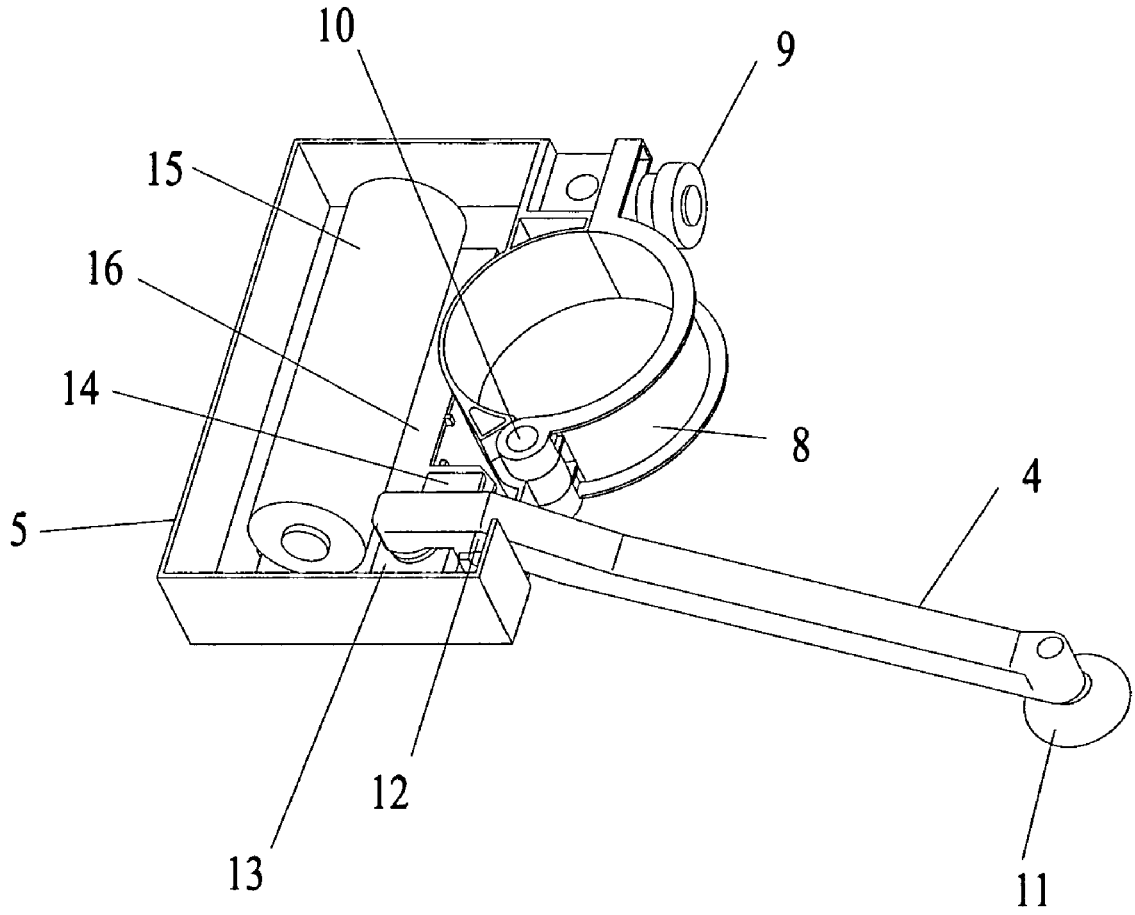
FIG. 6 is a top view of the compartment of FIG. 5 with the cover removed.
Figure 7:
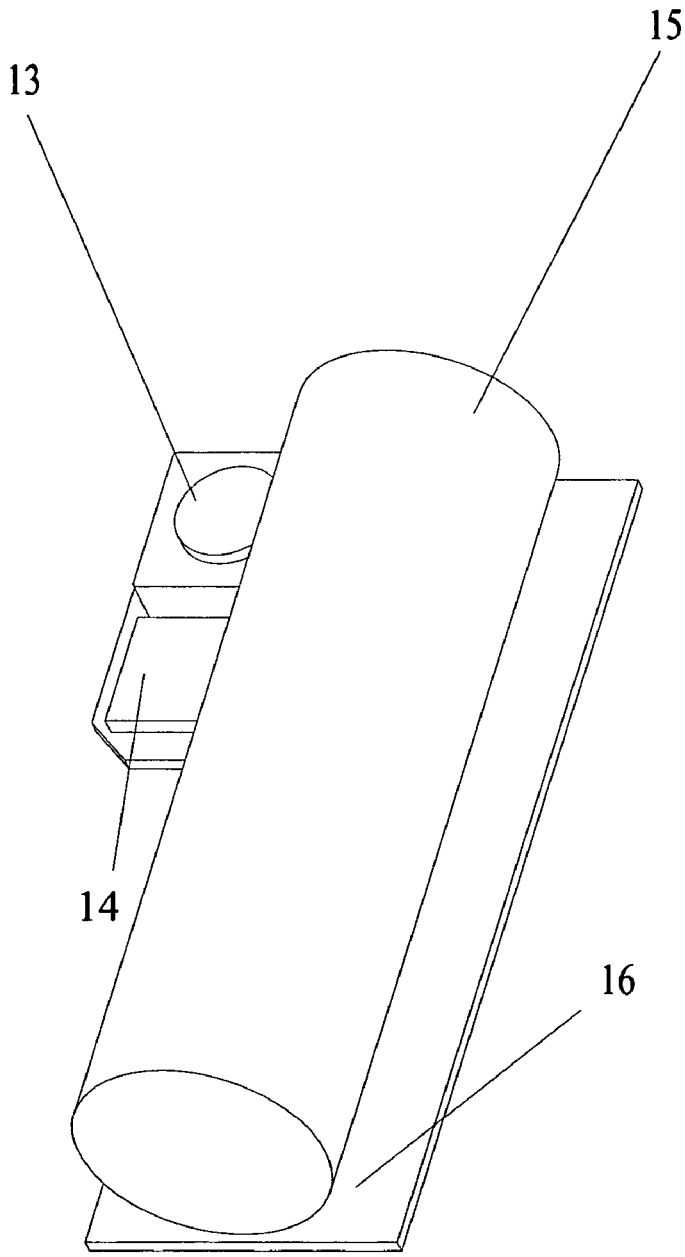
FIG. 7 is a view of the switch and transmitter assembly.

As shown in FIG. 3, without the chair, the switch compartment 5 has a collar 8, which can be attached to chair shaft 6 through the use of closure 9 and hinge 10. At the point of contact between rocker arm 4 and rail 3, there is a roller 11 attached to rocker arm 4 and set into rail 3. FIG. 4 shows a cutaway of the switch compartment 5, in which there is an axis 12 at which point the fulcrum of rocker arm 4 is fixed, a switch 13 in contact with the end of rocker arm 4 located in the switch compartment, a transmitter 14 connected to the switch 13, and a battery 15 connected to the transmitter 14. As shown in FIG. 7, the switch 13, transmitter 14, and battery 15 are all mounted on a board 16.

Once it is attached, when pressure is applied to chair seat 7, the switch compartment 5 will be lowered towards track mounting 1, the rocker arm 4 will pivot on fulcrum axis 12, and the switch 13 will be depressed. When pressure is released from chair seat 7, the switch compartment 4 will be raised away from track mounting 1, the rocker arm 4 will pivot on fulcrum axis 12, and the switch 13 will be released. When the switch 13 is depressed or released, it will cause transmitter 14 to transmit that event to a receiver attached to a computer or other device. Receiver behavior can be determined by the user in software or it can be predetermined based on the intended use of the device. The transmitter can use any wireless system desired, such as Bluetooth, RFID, or another protocol or method.

What is claimed is:

1. An interface comprising:

(a) a mounting, having an attachment side and a contact side, said attachment side being attachable to a chair;

(b) a circumferential rail on the contact side of said mounting;

(c) a housing attachable to a chair, having an inside, an outside, and an aperture;

(d) a lever, having a switch end and a contact end, the switch end located on the inside of the housing, the lever passing through the aperture, and the contact end in mobile contact with rail and the contact side of the mounting;

(e) a switch located inside the housing and in contact with the switch end of the lever so that it is selectively activated by the movement of said lever;

(f) a transmitter, linked to the switch and inside said housing;

(g) a power source linked to the transmitter and inside said housing;

(h) a receiver capable of receiving signals from the transmitter.

2. An interface as in claim 1 in which the transmitter and receiver are Bluetooth based.

3. An interface as in claim 1 in which the transmitter and receiver are RFID based.

4. An interface as in claim 1 in which the transmitter and receiver are WiFi based.

5. An interface as in claim 1 in which the interface is attached to a two part office chair.

6. An interface as in claim 1, further comprising a computer interface for said receiver, capable of controlling a computer in a manner customizable by a user.

7. An interface as in claim 1, further comprising a computer interface connected to said receiver which will disable a connected computer when the switch is released.

8. An interface comprising:

(a) a mounting, having a base side and rail side, said base side having adhesive affixed;

(b) a circular rail set on the rail side of said mounting;

(c) a housing enclosed on the bottom and four sides, having an interior, an open top, and an inside edge, said inside edge having a semicircular indentation and an aperture below said indentation;

(d) a removable top covering the open top of said housing;

(e) a fixed collar portion having a hinge end and a closure end, set into the indentation of the inside edge of said housing;

(f) a hinge, set at the hinge end of said fixed collar portion;

(g) a mobile collar portion having a hinge end and a closure end, attached to said hinge at its hinge end;

(h) a closure attached to the fixed collar portion at the closure end and capable of selectively fixing the closure end of the mobile collar portion in contact with the closure end of the fixed collar portion;

(i) a fulcrum set in the interior of the housing adjacent to the aperture;

(j) a switch set in the interior of the housing adjacent to the fulcrum on the opposite side of said fulcrum as the aperture;

(k) a rocker arm having a switch end, a roller end, and a pivot point between the two ends closer to the switch end, and attached to the fulcrum at said pivot point so that the switch end is located in the interior of the housing and in contact with the switch and the rocker arm passes through the aperture;

(l) a roller attached to the roller end of said rocker arm and positioned against the circular rail;

(m) a logic system connected to the switch;

(n) a transmitter controlled by said logic system;

(o) a power source connected to the switch, logic system, and transmitter;

(b) a receiver capable of receiving signals from said transmitter.

9. An interface as in claim 8 in which the transmitter and receiver are Bluetooth based.

10. An interface as in claim 8 in which the transmitter and receiver are RFID based.

11. An interface as in claim 8 in which the transmitter and receiver are WiFi based.

12. An interface as in claim 8 in which the interface is attached to a two part office chair.

13. An interface as in claim 8, further comprising a computer interface for said receiver, capable of controlling a computer in a manner customizable by a user.

14. An interface as in claim 8, further comprising a computer interface connected to said receiver which will disable a connected computer when the switch is released.

* * * * *